US011049441B2

(12) United States Patent
Luo

(10) Patent No.: US 11,049,441 B2
(45) Date of Patent: Jun. 29, 2021

(54) LED DISPLAY DEVICE AND METHOD FOR DRIVING THE SAME

(71) Applicant: HANGZHOU SHIXIN TECHNOLOGY CO., LTD., Hangzhou (CN)

(72) Inventor: Zheng Luo, Hangzhou (CN)

(73) Assignee: HANGZHOU SHIXIN TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 16/626,397

(22) PCT Filed: Sep. 6, 2018

(86) PCT No.: PCT/CN2018/104267
§ 371 (c)(1),
(2) Date: Dec. 24, 2019

(87) PCT Pub. No.: WO2020/010684
PCT Pub. Date: Jan. 16, 2020

(65) Prior Publication Data

US 2020/0320925 A1 Oct. 8, 2020

(30) Foreign Application Priority Data

Jul. 11, 2018 (CN) ..... 201810758390.7

(51) Int. Cl.
*G09G 3/32* (2016.01)

(52) U.S. Cl.
CPC ..... *G09G 3/32* (2013.01); *G09G 2310/0275* (2013.01); *G09G 2310/0294* (2013.01); *G09G 2330/021* (2013.01)

(58) Field of Classification Search
CPC ..... G09G 3/32; G09G 2310/0275; G09G 2310/0294; G09G 2330/021; G09G 2330/08; G09G 2330/12; G09G 2330/01
See application file for complete search history.

(56) References Cited

U.S. PATENT DOCUMENTS 8,860,320 B2 * 10/2014 Kang ..... H05B 45/20 315/186
9,035,935 B2 * 5/2015 Kawano ..... G09G 3/3233 345/212

(Continued)

FOREIGN PATENT DOCUMENTS

CN 105374317 A 3/2016
CN 105825806 A 8/2016

(Continued)

OTHER PUBLICATIONS

International Search Report and Written Opinion for International Application No. PCT/CN2018/104267, dated Mar. 27, 2019, 11 pages.

*Primary Examiner* — Michael J Jansen, II
(74) *Attorney, Agent, or Firm* — Westman, Champlin & Koehler, P.A.

(57) ABSTRACT

Disclosed is an LED display device and a method for driving the same. The LED display device comprises: an LED array comprising LEDs; a row driving module having output terminals, each of which is connected to a corresponding LED row for providing a supply voltage; constant current sources, each of which controls a driving current flowing through a corresponding LED column when a corresponding LED row is powered by the supply voltage; and voltage limiting modules, each of which is connected between a corresponding constant current source and a corresponding LED column. Current paths through a short-circuited LED and an open-circuited LED are disconnected by a corre- (Continued)

sponding voltage limiting module when there is a short-open failure in the LEDs. The LED display device can be used to improve image quality and reduce power consumption even if there is a short-open failure in the LEDs.

17 Claims, 5 Drawing Sheets

(56) References Cited

U.S. PATENT DOCUMENTS

| | | | | |
|---|---|---|---|---|
| 9,210,747 | B2 * | 12/2015 | Zhang | H05B 45/37 |
| 9,443,478 | B2 * | 9/2016 | Min | G09G 3/3406 |
| 9,781,806 | B1 | 10/2017 | Yeh et al. | |
| 10,255,857 | B2 * | 4/2019 | Hyeon | G09G 3/3216 |
| 2008/0068298 | A1 * | 3/2008 | Shen | G09G 3/14 345/46 |
| 2011/0298384 | A1 * | 12/2011 | Tanigawa | H05B 45/46 315/209 R |
| 2013/0038819 | A1 * | 2/2013 | Ishikawa | H05B 45/46 349/69 |
| 2013/0049614 | A1 * | 2/2013 | Kang | H05B 45/37 315/186 |
| 2013/0278586 | A1 * | 10/2013 | Kawano | G09G 5/001 345/212 |
| 2014/0375930 | A1 * | 12/2014 | Zhang | H05B 45/38 349/69 |
| 2016/0042699 | A1 * | 2/2016 | Min | G09G 3/3413 345/82 |
| 2017/0069270 | A1 * | 3/2017 | Hyeon | G09G 3/3216 |

FOREIGN PATENT DOCUMENTS

| | | | |
|---|---|---|---|
| CN | 106033661 | A | 10/2016 |
| CN | 107770901 | A | 3/2018 |
| CN | 207165213 | U | 3/2018 |
| CN | 108109579 | A | 6/2018 |
| WO | 2008/099979 | A2 | 8/2008 |

* cited by examiner

- Prior Art -

- Prior Art -

LED DISPLAY DEVICE AND METHOD FOR DRIVING THE SAME

CROSS-REFERENCE TO RELATED APPLICATION

This application is a Section 371 National Stage application of International Application No. PCT/CN2018/104267, filed on 6 Sep. 2018, which has not yet published, and claims priority to the Chinese Patent Application No. 201810758390.7, filed on Jul. 11, 2018, entitled "LED display device and method for driving the same", the contents of which are incorporated herein by reference in their entireties.

BACKGROUND OF THE DISCLOSURE

Field of the Disclosure

The present invention relates to LED display technology, and more particularly, to an LED display device and a method for driving the same.

Description of the Related Art

LED display devices have been widely used in the field of display. An LED display device has advantages of high brightness, wide viewing angle, rich colors and customizable screen shape, thus widely used in industry, transportation, commercial advertising, information publishing, sports and some other fields.

LEDs are used as pixel elements in the LED display device, wherein a plurality of LEDs are arranged to form a pixel array. During operation, for example, the LED display device is configured to scan the LED array row by row, to provide a series connection between each constant current source and a selected one of the LEDs being scanned, so that each LED in the LED row being scanned can be turned on. By current control method or turn-on time control method, brightness of the LEDs being scanned can be controlled, thus multi-level gray scales can be displayed. The current control method controls the brightness of each LED by adjusting the current flowing through that LED. The turn-on time control method controls the brightness of each LED by regulating a duty cycle of a constant current when that LED is driven by the constant current.

However, in practical applications, the LED display device is often required to work for a long time, and sometimes the LED display device is required to operate in poor environment with high temperature and high humidity, so that the LEDs may be easily damaged and cause a short-open failure. When there is a short-open failure caused by damaged LEDs, not only the damaged LEDs themselves cannot be turned on, but also an unexpected current path may be caused by the damaged LEDs, so that an unselected LED will be turned on abnormally, lightening an unexpected pixel. Such an abnormal lightening phenomenon may lead to image display abnormality. As area of the LED display device is becoming increasingly large, the number of LEDs is growing, and occurrence probability of the short-open failure is increasing greatly. Once a short-open failure occurs, image quality will be greatly affected.

Therefore, further improvements are expected to improve the LED display device, in order to maintain image quality even when there is a short-open failure caused by damaged LEDs.

SUMMARY OF THE DISCLOSURE

An object of the present invention is to provide an LED display device and a method for driving the same, wherein a voltage limiting module is used to improve image quality and reduce power consumption when there is a short-open failure.

According to an aspect of the present invention, there is provided an LED display device, comprising: an LED array comprising a plurality of LEDs which are arranged to form a plurality of LED rows and a plurality of LED columns; a row driving module having a plurality of output terminals, each of which is connected to a corresponding one of the plurality of LED rows of the plurality of LEDs for providing a supply voltage; a plurality of constant current sources, each of which is configured to control a driving current flowing through a corresponding one of the plurality of LED columns of the plurality of LEDs in accordance with display data when a corresponding one of the plurality of LED rows of the plurality of LEDs is powered by the supply voltage, so that brightness is corresponding to the display data; and a plurality of voltage limiting modules, each of which is configured to be connected between a corresponding one of the plurality of constant current sources and a corresponding one of the plurality of LED columns of the plurality of LEDs, wherein a current path through the LED arranged in a same LED row with a short-circuited one of the plurality of LEDs and the LED arranged in a same LED row with an open-circuited one of the plurality of LEDs is disconnected by a corresponding one of the plurality of voltage limiting modules when there is a short-open failure occurring in the plurality of LEDs, preventing the plurality of LEDs from being turned on abnormally.

Preferably, each one of the plurality of constant current sources is configured to control at least one of a duty cycle and a current value of the driving current, according to the display data.

Preferably, the plurality of output terminals of the row driving module are configured to couple with anodes of the plurality of LED rows of the plurality of LEDs, respectively, and each of the plurality of constant current sources is configured to couple to cathodes of a corresponding one of the plurality of LED columns of the plurality of LEDs through a corresponding one of the plurality of voltage limiting modules.

Preferably, the plurality of voltage limiting modules are configured to obtain comparison results by comparing a reference voltage with each one of a plurality of terminal voltages of the plurality of constant current sources, and to determine whether the short-open failure occurs in the plurality of LEDs according to the comparison results.

Preferably, each one of the plurality of terminal voltages of the plurality of constant current sources is equal to a first voltage under a non-operating state, to a second voltage under a normal-operating state, and to a third voltage under an abnormal-operating state, wherein the reference voltage is less than the first voltage, less than the second voltage and higher than the third voltage.

Preferably, under the normal-operating state, each one of the plurality of constant current sources is configured to provide the driving current flowing through a first current path, wherein the first current path is configured to reach a corresponding one of the plurality of constant current sources through the LED which is arranged in a corresponding one of the plurality of LED rows, when that corresponding one of the plurality of LED rows obtains the supply voltage.

Preferably, among the plurality of constant current sources, each constant current source operating under the abnormal-operating state is configured to provide the driving current flowing through a second current path, wherein the second current path is configured to reach a corresponding one of the plurality of constant current sources through at least one of the LEDs arranged in the LED row comprising a short-circuited LED and at least one of the LEDs arranged in the LED row comprising an open-circuited LED, when the LEDs arranged in a corresponding LED row obtain the supply voltage.

Preferably, when the LEDs arranged in a corresponding one of the plurality of LED rows of the plurality of LEDs obtain the supply voltage, the second current path turns on for a transient time and then turns off.

Preferably, the first voltage is roughly equal to the supply voltage, the second voltage is roughly equal to the supply voltage minus a first turn-on voltage drop across a single one of the plurality of LEDs, the third voltage is roughly equal to the supply voltage minus a second turn-on voltage drop across two series-connected LEDs of the plurality of LEDs.

Preferably, each of the plurality of voltage limiting modules comprises: a comparator having a positive input terminal configured to receive a voltage sampling signal representing a corresponding one of the plurality of terminal voltages of the plurality of constant current sources, a negative input terminal configured to receive the reference voltage, and an output terminal providing a switching control signal; and a switch having a control terminal coupled to the output terminal of the comparator for receiving the switching control signal, a first current terminal coupled to the cathodes of the LEDs arranged in a corresponding one of the plurality of LED columns, and a second current terminal coupled to a high-voltage terminal of a corresponding one of the plurality of constant current sources.

Preferably, the positive input terminal of the comparator is configured to be connected to the first current terminal of the switch for obtaining the voltage sampling signal.

Preferably, the LED display device further comprises a plurality of capacitors, each one of the plurality of capacitors is connected between ground and the positive input terminal of the comparator in a corresponding one of the plurality of voltage limiting modules, in order to store the corresponding voltage sampling signal during a frame cycle.

Preferably, the plurality of capacitors are parasitic capacitors or additional capacitance elements.

According to another aspect of the present invention, there is provided a method for driving an LED display device, wherein the LED display device comprises an LED array comprising a plurality of LEDs arranged to form a plurality of LED rows and a plurality of LED columns, the method comprises: scanning the plurality of LED rows in each frame cycle; providing a supply voltage to a corresponding one of the plurality of LED rows of the plurality of LEDs in each row scanning phase of the frame cycle; controlling a driving current flowing through a corresponding one of the plurality of LED columns of the plurality of LEDs according to display data, so that brightness is corresponding to the display data; and turning off current paths through a short-circuited one of the plurality of LEDs and an open-circuited one of the plurality of LEDs when there is a short-open failure occurring in the plurality of LEDs, for preventing the plurality of LEDs from being abnormally lightened.

Preferably, in the step of controlling the driving current, at least one of the duty cycle and the current value of the driving current is controlled according to the display data.

Preferably, the method further comprises: controlling the driving currents each flowing through the plurality of LED columns of the plurality of LEDs by use of a plurality of constant current sources, respectively; and comparing a reference voltage with voltage sampling signals representing terminal voltages of the plurality of constant current sources to obtain comparison results, and determining whether a short-open failure occurs in the plurality of LEDs according to the comparison results.

Preferably, the terminal voltage of each of the plurality of constant current sources is equal to a first voltage under a non-operating state, to a second voltage under a normal-operating state, and to a third voltage under an abnormal-operating state, wherein the reference voltage is less than the first voltage, less than the second voltage and higher than the third voltage.

Preferably, under the normal-operating state, each of the plurality of constant current sources is configured to provide the driving current flowing through a first current path, wherein the first current path is configured to reach a corresponding one of the plurality of constant current sources through a corresponding one of the plurality of LED rows, when that corresponding one of the plurality of LED rows obtains the supply voltage.

Preferably, among the plurality of constant current sources, the constant current source operating under the abnormal-operating state is configured to provide the driving current flowing through a second current path, wherein the second current path is configured to reach a corresponding one of the plurality of constant current sources through at least one of the LEDs arranged in the LED row comprising a short-circuited LED and at least one of the LEDs arranged in the LED row comprising an open-circuited LED, when a corresponding one of the plurality of LED rows obtains the supply voltage.

Preferably, in each row scanning phase, when the LEDs arranged in a corresponding one of the plurality of LED rows obtain the supply voltage, the second current path turns on for a transient time and then turns off.

Preferably, the first voltage is roughly equal to the supply voltage, the second voltage is roughly equal to the supply voltage minus a first turn-on voltage drop across a single one of the plurality of LEDs, the third voltage is roughly equal to the supply voltage minus a second turn-on voltage drop across two series-connected LEDs of the plurality of LEDs.

Preferably, capacitors are introduced for storing the voltage sampling signals during the frame cycle.

The LED display device and a method for driving the same according to the embodiments of the present disclosure introduce voltage limiting modules each connected between a corresponding constant current source and a corresponding LED column, wherein each voltage limiting module may turn off the current paths through the short-circuited LED and the open-circuited LED when there is a short-open failure occurring in the LED array, in order to prevent the plurality of LEDs from being abnormally lightened, thus image display quality can be improved and power consumption can be reduced.

In some preferred embodiments, each voltage limiting module is configured to detect the short-open failure according to a corresponding one of the terminal voltages of the plurality of constant current sources. When the corresponding one of the terminal voltages is lower than the predetermined reference voltage, the corresponding voltage limiting module is configured to disconnect the corresponding constant current source with the corresponding LED column, thus turning off the current paths through the short-circuited LED and the open-circuited LED. The voltage limiting modules do not require complex detecting circuits or logic circuits, thus further reducing circuit cost.

BRIEF DESCRIPTION OF THE DRAWINGS

By following description of embodiments with reference to the accompanying drawings of the present invention, the above and other objects, features and advantages of the present invention will become apparent.

DETAILED DESCRIPTION OF THE DISCLOSURE

Various embodiments of the present invention will be described in more detail with reference to figures of the embodiments. In the figures, the same elements are referenced by same or similar identical reference markings. For clarity, elements in the figures are not drawn to scale.

In the description of the present disclosure, a short-open failure represents that at least one of LEDs in an LED array of the LED display device is short-circuited and at least another one of the LEDs in the LED array of the LED display device is open-circuited.

Figure 1:
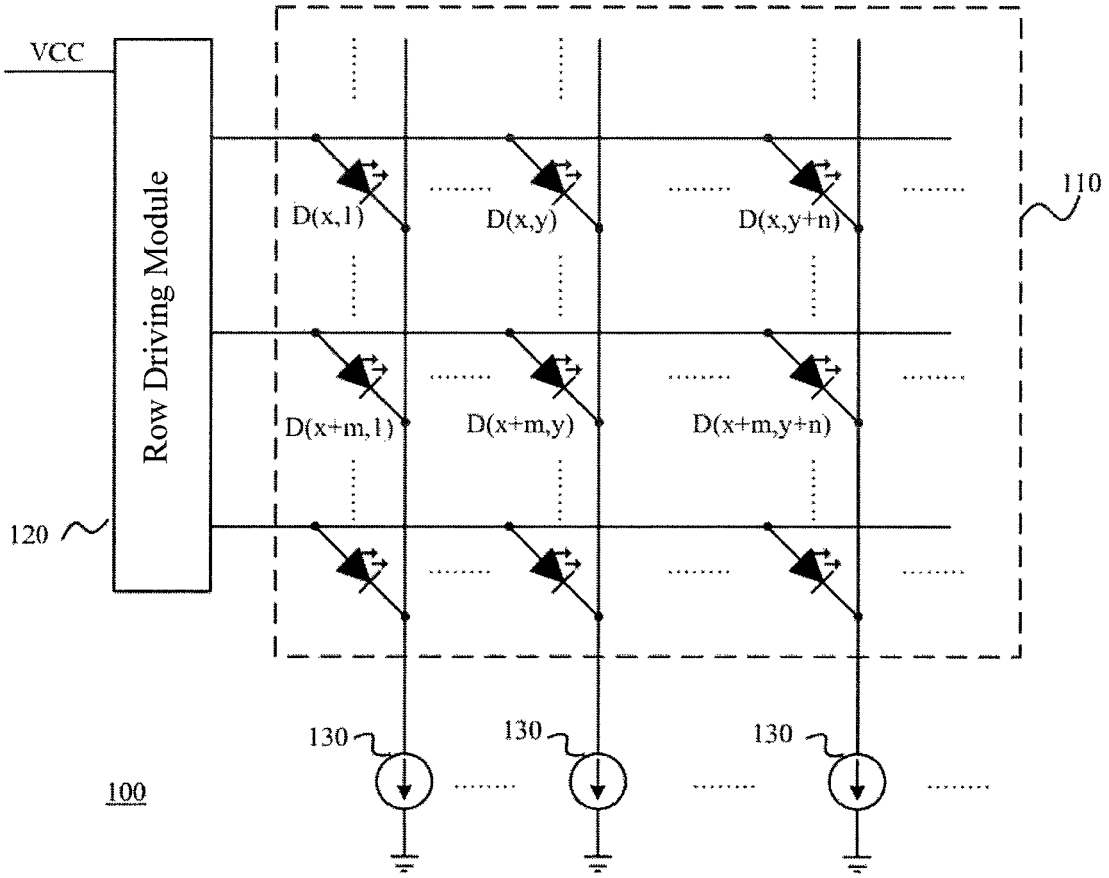
FIG. 1 shows a schematic diagram of an LED display device according to the prior art.

FIG. 1 shows a schematic diagram of an LED display device according to the prior art. In this embodiment, the LED display device has a common-anode structure.

As shown in FIG. 1, the LED display device 100 comprises an LED array 110, a row driving module 120, and a plurality of constant current sources 130. The LED array 110 comprises a plurality of pixel cells arranged in rows and columns, for instance, a pixel array is formed by the plurality of pixel cells. In the LED display device for monochrome display, each pixel cell comprises an LED providing monochrome light. In the LED display device for color display, each pixel cell comprises three LEDs providing red light, green light and blue light, respectively. Anodes of the LEDs arranged in a same LED row of the LED array 110 are coupled with each other. A plurality of output terminals of the row driving module 120 are connected to anodes of the LED rows in the LED array, respectively, for providing a supply voltage VCC. Cathodes of the LEDs arranged in a same LED column of the LED array 110 are connected to each other, and each of the cathodes of the LEDs arranged in a same LED column of the LED array 110 is coupled to ground through a corresponding constant current source 130.

During operation, the LED array is scanned row by row in each frame cycle. The row driving module 120 is configured to select one of the LED rows in the LED array and provide the supply voltage VCC to the anode of the selected LED row during a corresponding row scanning phase of the frame cycle, according to a scanning signal. When the selected LED row is powered by the supply voltage VCC, the corresponding constant current source 130 is configured to generate a driving current, and the duty cycle and the current value of the driving current can be changed in accordance with display data, thus the brightness of the corresponding LED may be determined by both of the current value and the duty cycle. At any given time, only one scanning signal should be valid, which determines that only the LEDs arranged in one LED row corresponding to that scanning signal can be powered and turned on by the supply voltage VCC, and the LEDs arranged in other LED rows should be turned off.

In one frame cycle, the LEDs of the pixel array are scanned row by row, the constant current sources provide constant currents to the selected LEDs according to the display data. Therefore, the LEDs in the pixel array have brightness values related to gray scale levels of the pixel cells in a frame image, respectively, so that the frame image can be displayed.

Figure 2:
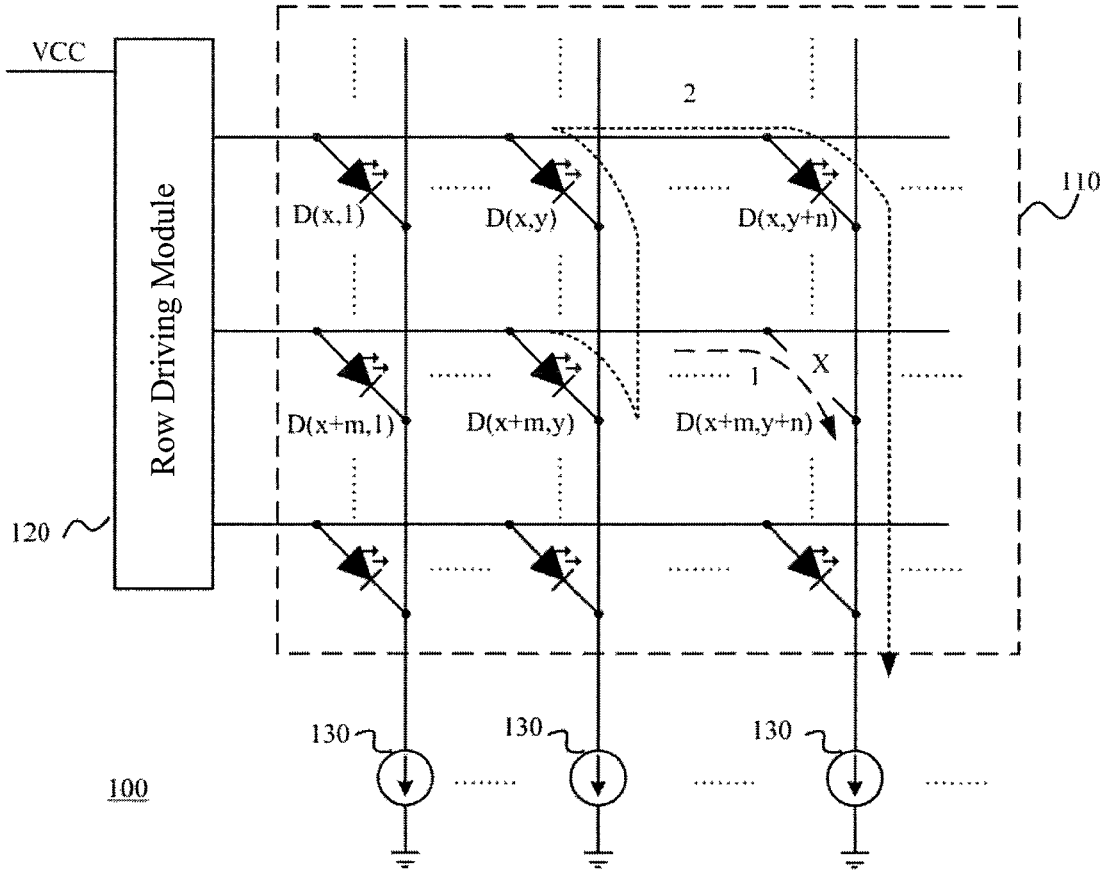
FIG. 2 shows current paths provided by the LED display device shown in FIG. 1 when there is a short-open failure occurring in the LED display device.

FIG. 2 shows current paths in the LED display device shown in FIG. 1 when there is a short-open failure occurring in the LED display device. The figure shows an equivalent schematic diagram under a condition that the LED in row x and column y is short-circuited.

According to the LED display device 100 shown in FIG. 2, the plurality of LEDs in the pixel array are scanned row by row. When the LEDs arranged in row (x+m) are powered by the row driving module 120, the LED in row (x+m) and column (y+n) is configured to receive the supply voltage VCC.

Under a condition that the LED in row (x+m) and column (y+n) is not open-circuited, a first current path is formed. That is, the LED in row (x+m) and column (y+n) is turned on, and the first current path through the LED in row (x+m) and column (y+n) is formed. All of the LEDs arranged in row (x+m) can be normally turned on, and all of the LEDs arranged in other LED rows can be normally turned off.

Under a condition that the LED in row (x+m) and column (y+n) is open-circuited, a second current path is formed. That is, the LED in row (x+m) and column (y+n) is turned off, and the second current path through the LED in row x and column y and the LED in row x and column (y+n) is formed. All of the LEDs in row (x+m) except the LED in column y and the LED in column (y+n) can be turned on normally, while the LED in row (x+m) and column y and the LED in row x and column (y+n) will be turned on abnormally.

Specifically, under the condition that the LED in row (x+m) and column (y+n) is open-circuited, the above-mentioned first current path is not conductive. At this time, if the LED arranged in the selected row and in the same column with the LED in row x and column y is not required to be turned on, that is, the LED in row (x+m) and column y shown in FIG. 2 is not required to be turned on, because that the supply voltage VCC provided to the LEDs in row (x+m) is 5V and the LED in row x and column y is short-circuited, there is a path shown as the second current path in FIG. 2 passing through the LED in row (x+m) and column y, the LED in row x and column y, the LED in row x and column (y+n) and the corresponding constant current source to ground, the second current path will make the LED in row (x+m) and column y and the LED in row x and column (y+n) abnormally turned on.

Figure 3:
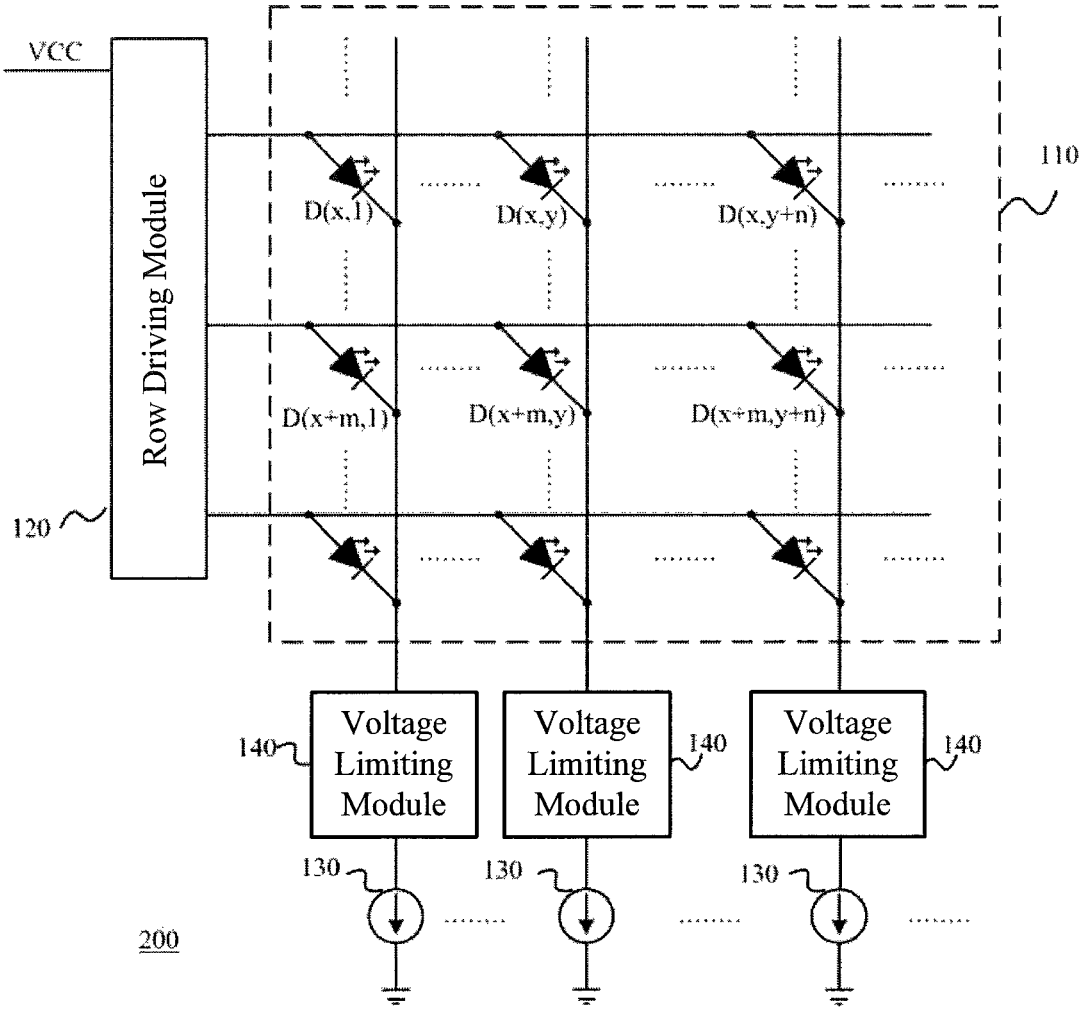
FIG. 3 shows a schematic diagram of an LED display device according to an embodiment of the present disclosure.

FIG. 3 shows a schematic diagram of an LED display device according to an embodiment of the present disclosure.

As shown in FIG. 3, an LED display device 200 comprises an LED array 110, a row driving module 120, a plurality of constant current sources 130, a plurality of voltage limiting modules 140. The LED array 110 comprises a plurality of pixel cells arranged in rows and columns, for example, the plurality of pixel cells are arranged to form a pixel array. In the LED display device for monochrome display, each pixel cell comprises one LED providing monochrome light. In the LED display device for color display, each pixel cell comprises three LEDs providing red light, green light and blue light, respectively. Anodes of the LEDs arranged in a same LED row of the LED array 110 are coupled with each other. A plurality of output terminals of the row driving module 120 are connected to anodes of the plurality of LED rows in the LED array, respectively, for providing a supply voltage VCC. Cathodes of the LEDs arranged in a same LED column of the LED array 110 are connected to each other, and each of the cathodes of the LEDs arranged in a same LED column of the LED array 110 is coupled to ground through a corresponding constant current source 130.

In this embodiment, the supply voltage VCC is, for example, 5V, and a turn-on voltage drop of each LED is about 2V to 3V.

Each of the plurality of constant current sources 130 is coupled to a cathode of a corresponding LED column of the LED array through a corresponding voltage limiting module 140, thus providing constant current to an LED which is selected to be turned on in the corresponding LED column. For example, the brightness of the selected LED is determined by the turn-on time duty cycle and the current value of the constant current provided by the corresponding constant current source 130 together.

During operation, the LED array is scanned row by row in each frame cycle. The row driving module 120 is configured to select one of the LED rows in the LED array and provide the supply voltage VCC to the anode of the selected LED row during a corresponding row scanning phase of the frame cycle, according to one of scanning signals SCAN1 to SCANn. When the selected LED row is powered by the supply voltage VCC, the corresponding constant current source 130 is configured to generate a driving current, and the duty cycle and the current value of the driving current can be changed in accordance with display data, thus brightness of the corresponding LED may be determined by both of the current value and the duty cycle. At any given time, only one scanning signal should be valid, which determines that only the LEDs arranged in one LED row corresponding to that scanning signal can be powered and turned on by the supply voltage VCC, and the LEDs arranged in other LED rows should be turned off.

In each frame cycle, the LEDs of the pixel array are scanned row by row, the constant current sources provide constant currents to the selected LEDs according to the display data. Therefore, the LEDs in the pixel array have brightness values related to gray scale levels of the pixel cells in a frame image, respectively, so that the frame image can be displayed.

Different from the LED display device 100 according to the prior art shown in FIG. 1, the LED display device 200 according to this embodiment of the present disclosure comprises a plurality of voltage limiting modules 140. Each voltage limiting module 140 is configured to detect a terminal voltage of a corresponding constant current source 130. If the terminal voltage is lower than a predetermined reference voltage Vos, the detected constant current source 130 is controlled to be disconnected to the corresponding LED column by the voltage limiting module 140, thus a current path through the corresponding LED column will be turned off. The LED display device 200 can prevent the plurality of LEDs from being abnormally turned on even if there is a short-open failure occurring in the LED display device, thus improving image quality.

Figure 4:
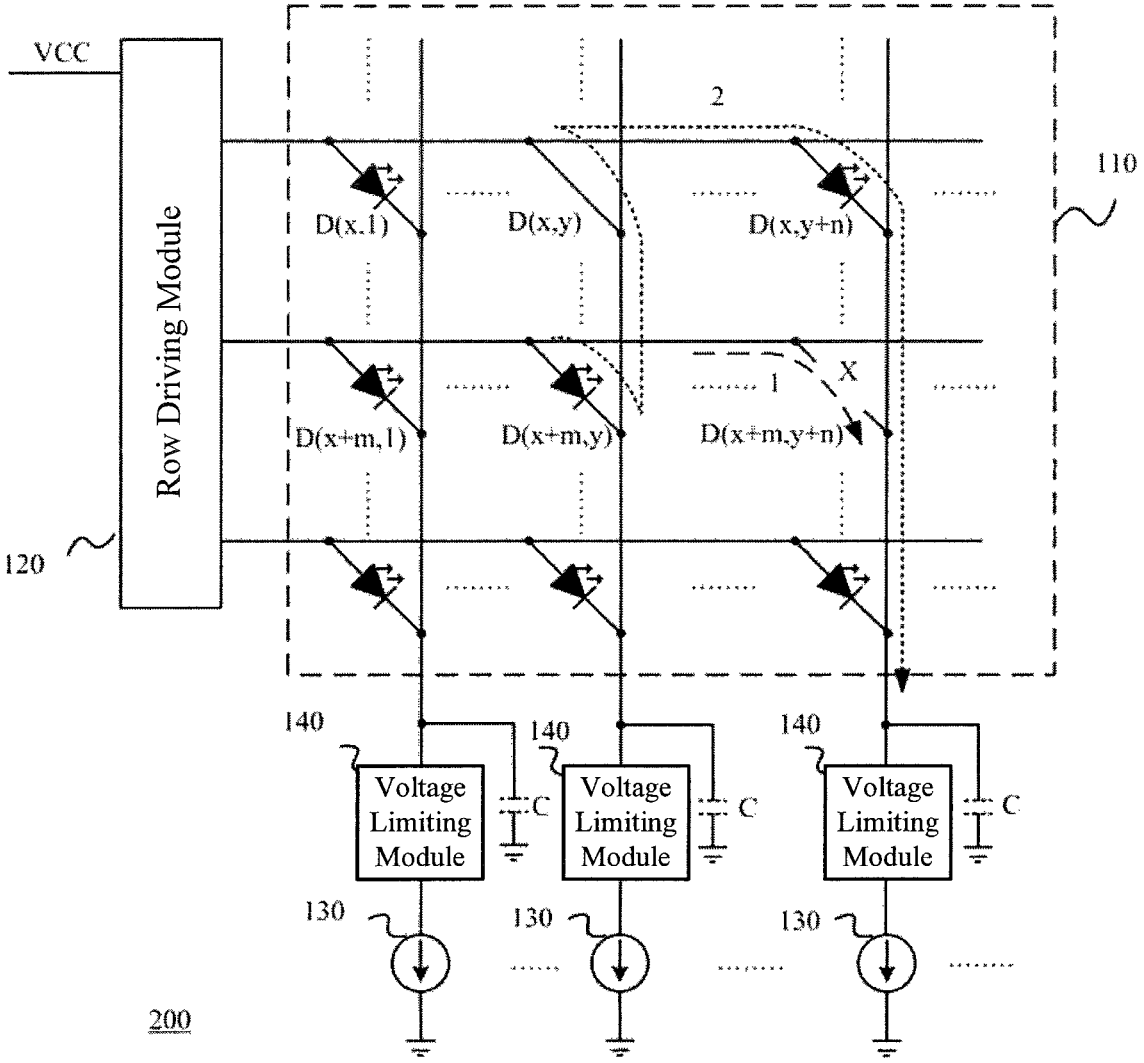
FIG. 4 shows current paths provided by the LED display device shown in FIG. 3 when there is a short-open failure occurring in the LED display device.

FIG. 4 shows current paths in the LED display device shown in FIG. 3 when there is a short-open failure occurring in the LED display device.

As described above, in the LED display device 200 according to this embodiment, each voltage limiting module 140 is configured to detect the terminal voltage of the corresponding constant current source 130. The terminal voltage of the corresponding constant current source 130 is a first voltage V1 under non-operating state, and is a second voltage V2 under normal-operating state, wherein the first voltage V1 is higher than the second voltage V2. For instance, the first voltage V1 is equal to the supply voltage VCC, and the second voltage V2 is equal to the supply voltage VCC minus a turn-on voltage drop Von of one LED.

When there is a short-open failure occurring in the LED array, a current path through the LED row comprising a short-circuited LED and the LED column comprising an open-circuited LED is formed, wherein the terminal voltage of the constant current source 130 corresponding to the LED column comprising the open-circuited LED is equal to a third voltage V3, the third voltage V3 is an abnormal voltage, wherein the third voltage V3 can be calculated by subtracting two times of the turn-on voltage drop Von of an LED from the supply voltage VCC.

In this embodiment, range of the reference voltage Vos is set to be lower than each of the normal terminal voltages V1 and V2, and is set to be higher than the terminal voltage V3 which is generated when there is a short-open failure. For example, suppose that the supply voltage VCC=5V, the turn-on voltage drop of an LED Von=2V, when the LEDs are turned on normally, the terminal voltage of the constant current source is equal to the second voltage V2=3V, and when the short-open failure occurs in the LED array, the terminal voltage of the corresponding constant current source 130 is equal to V3=1V. Under this situation, the reference voltage Vos can be slightly lower than 3V.

For example, in the LED display device shown in FIG. 3, suppose that a short-circuited LED is in row x, and an open-circuited LED is in column (y+n), for example, a first LED in row x and column y is short-circuited and a second LED in row (x+m) and column (y+n) is open-circuited, wherein n LED rows and m LED columns are arranged between the first LED and the second LED. When the (x+m)th LED row is selected to be turned on, the LEDs arranged in that LED row obtain the supply voltage VCC.

If the LED in row (x+m) and column (y+n) is not open-circuited, then it is selected to be turned on. Under this situation, the terminal voltage of the constant current source 130 corresponding to the corresponding LED column is equal to the second voltage V2=3V, which is calculated by subtracting a turn-on voltage drop Von of an LED in the LED array from the supply voltage VCC. The second voltage V2 is higher than the reference voltage Vos, the corresponding constant current source 130 may operate normally to provide a pull-down constant current, thus the first current path is formed through that LED in row (x+m) and column (y+n).

If the LED in row (x+m) and column (y+n) is open-circuited, then it will be turned off. Under this situation, the terminal voltage of the constant current source 130 corresponding to the corresponding LED column is detected by a corresponding one of the voltage limiting modules 140 and is equal to the third voltage V3=1V, which is calculated by subtracting two times of a turn-on voltage drop Von of an LED in the LED array from the supply voltage VCC. The third voltage V3 is lower than the reference voltage Vos, the corresponding constant current source 130 is turned off, thus breaking the second current path through the LED row comprising the short-circuited LED and the LED column comprising the open-circuited LED.

Operation process of each voltage limiting module 140 is described in the following description, in connection with frame cycles of the LED display device 200. In the LED display device 200 shown in FIG. 3, suppose that a short-circuited LED is in row x, and an open-circuited LED is in column (y+n), for example, a first LED in row x and column y is short-circuited and a second LED in row (x+m) and column (y+n) is open-circuited, wherein n LED rows and m LED columns are arranged between the first LED and the second LED. An equivalent circuit diagram is shown in FIG. 4.

In this embodiment, each capacitor C represents a parasitic capacitor commonly existing in the LED display device. In some alternative embodiments, each capacitor C represents an additional capacitor connected between the input terminal of the corresponding voltage limiting module and ground. According to the following description, each capacitor C is configured to store the terminal voltage of the corresponding constant current source 130 during each frame cycle.

In each frame cycle, the row driving module 120 may control its power supply terminal to provide the supply voltage VCC to each LED row of the LED array 120 successively, that is, the LEDs will be turned on row by row in proper sequence.

Before the LED row comprising the open-circuited LED is turned on, when any of the LEDs arranged in the LED column comprising the open-circuited LED is turned on, the terminal voltage of the constant current source 130 corresponding to the LED column comprising the open-circuited LED is equal to the second voltage V2=3V. When turn-on time of that LED column is over and the corresponding constant current source is turned off, the terminal voltage of the constant current source 130 corresponding to the corresponding LED column will be maintained at 3V because of parasitic capacitance. Then, if the LEDs arranged in that LED column are not required to be turned on, the terminal voltage of the constant current source 130 corresponding to that LED column will be maintained at 3V.

When the LED row comprising the open-circuited LED in row (x+m) and column (y+n) is turned on, that is, when the (x+m)th row is selected and obtains the supply voltage VCC, if the LED in row (x+m) and column (y+n) is required to be turned on, at this time, a transient path is provided from the LED in row (x+m) and column y to ground, successively through the LED in row x and column y, the LED in row x and column (y+n) and the corresponding constant current source, making the terminal voltage of the constant current voltage corresponding to the (y+n)th LED column drop to 1V instantly. At this time, the corresponding voltage limiting module 140 operates, and because the terminal voltage of the corresponding constant current source 130 is lower than the predetermined reference voltage Vos, the constant current source 130 corresponding to the corresponding LED column will be turned off immediately by the voltage limiting module 140, thus the second current path is turned off. After the second current path is turned off, the terminal voltage of the constant current source 130 corresponding to that LED column is maintained at 1V, and will be recovered to 3V when any of the LEDs in that LED column is normally turned on next time.

In one frame cycle, before the LEDs arranged in the same LED row with the open-circuited LED in row (x+m) and column (y+n) are turned on, if the LEDs arranged in the same LED column with the open-circuited LED are not required to be turned on and only the open-circuited LED was once lightened, the terminal voltage of the constant current source 130 corresponding to the (y+n)th LED column is 1V at this time, according to the above-mentioned analysis.

When the LED row comprising the open-circuited LED in row (x+m) and column (y+n) is turned on, that is, the (x+m)th row is selected and obtains the supply voltage VCC, at this time, the corresponding voltage limiting module 140 may detect that the terminal voltage of the corresponding constant current source is 1V, which is lower than the predetermined reference voltage, thus the voltage limiting module 140 may not turn on the constant current source, and the second current path will not be formed. The terminal voltage will be recovered to 3V when any of the LEDs in that LED column is normally turned on next time.

Therefore, even if there is a short-open failure occurs in the LED display device 200, the LED display device can prevent the plurality of LEDs from being abnormally turned on, thus improving image quality.

Figure 5:
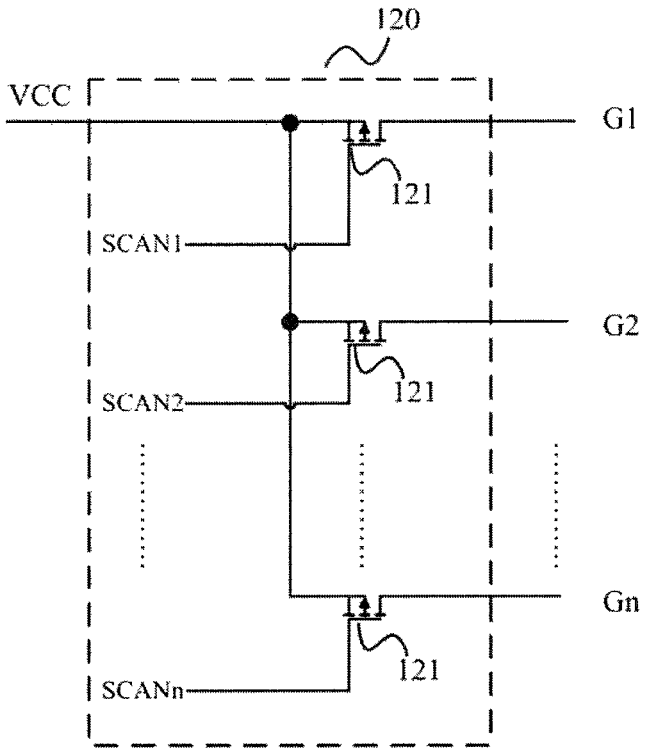
FIG. 5 shows a schematic diagram of a row driving module of the LED display device shown in FIG. 3.

FIG. 5 shows a schematic diagram of the row driving module of the LED display device shown in FIG. 3.

In the LED display device 200, the row driving module 120 comprises a plurality of switches 121, each of which is, for example, a P-channel metal oxide semiconductor field effect transistor (PMOSFET) having a source electrode as a first terminal for receiving the supply voltage VCC and a drain electrode as a second terminal connected to an anode of a corresponding LED row of the LED array 110.

During operation, the row driving module 120 may selectively turn on one of the switches 121, according to one of the scanning signals SCAN1 to SCANn, for providing the supply voltage VCC through the selected switch 121 to the anodes of the LEDs arranged in the corresponding LED row.

Figure 6:
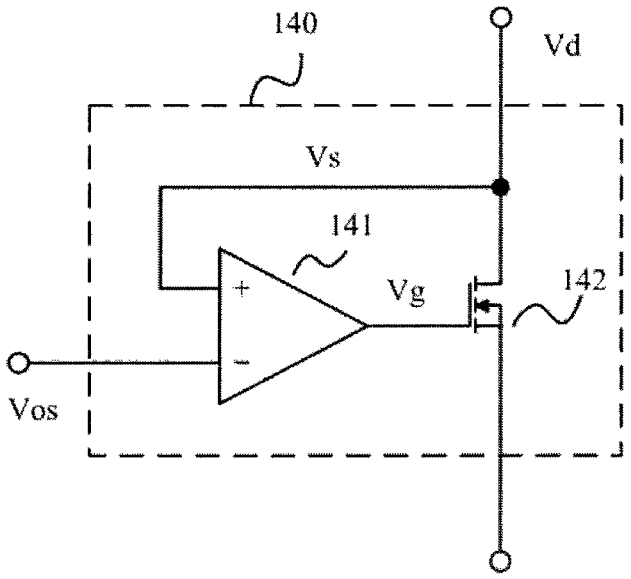
FIG. 6 shows a schematic diagram of a voltage limiting module of the LED display device shown in FIG. 3.

FIG. 6 shows a schematic diagram of the voltage limiting module of the LED display device shown in FIG. 3.

In the LED display device 200, each voltage limiting module 140 may have different implementations. As shown in FIG. 6, each voltage limiting module 140 may comprise a comparator 141 and a switch 142. The switch 142 is, for example, an N-channel metal-oxide-semiconductor field effect transistor (NMOSFET).

In each voltage limiting module 140, the switch 142 is connected to the corresponding constant current source 130 in series. Under a condition that the switch 142 is an NMOSFET, the source electrode of the switch 142 is connected to the high-voltage terminal of the corresponding constant current source 130, and the drain electrode of the switch 142 is connected to the cathodes of the LEDs arranged in the corresponding LED column.

The comparator 141 has a positive input terminal configured to receive a voltage sampling signal Vs representing the terminal voltage of the corresponding constant current source 130, a negative input terminal configured to receive the reference voltage Vos, and an output terminal configured to connected to the control terminal of the switch 142 for providing a switching control signal Vg. In this embodiment, the positive input terminal of the comparator 141 is connected to the drain electrode of the switch 142, so that drain voltage Vd of the switch 142 is considered as the terminal voltage of the corresponding constant current source 130.

The comparator 141 is configured to compare the terminal voltage of the corresponding constant current source 130 and the reference voltage Vos, thus generating the switching control signal Vg. When Vd>Vos, output result generated by the comparator 141 is 1, so that the switch 142 is turned on. When Vd<Vos, output result generated by the comparator 141 is 0, so that the switch 142 is turned off.

It should be noted that, the above-described implementation of the voltage limiting module 140 is only an example, the switch 142 may be an additional switch or a reused switch comprised by an existing terminal circuit of constant current source, the purpose of introducing the switch 142 is to build or break conductive path controllably. In this embodiment, the voltage limiting module 140 is designed to comprise a comparator and a switch, which is only one of the embodiments of the voltage limiting module. In alternative embodiments, any other circuits may also be designed as the voltage limiting module 140, as long as the constant current source 130 can be turned off under a predetermined voltage range.

The above-described embodiments are just some of the examples of the present disclosure, basic idea of the present disclosure is to provide a new LED display device and a method for driving the same, in order to solve the problem that the short-open failure occurring in the LED array in the prior art may lead to image errors, to improve reliability of display system and other display performance.

In accordance with the example embodiment of the present invention described above, the description of embodiments of the present invention are not intended to be exhaustive or limited to embodiments of the invention in the form disclosed. Obviously, according to the above description, there may be many modifications and variations. The embodiments in the present disclosure was chosen and described in order to explain the principles of the invention and as a practical application to enable one skilled in the art to well utilize the invention in various embodiments and with various modifications. The scope of the invention should be limited by the claims of the invention.

The invention claimed is:

1. An LED display device, comprising:

an LED array comprising a plurality of LEDs which are arranged to form a plurality of LED rows and a plurality of LED columns;

a row driving module having a plurality of output terminals, each of which is connected to a corresponding one of said plurality of LED rows of said plurality of LEDs for providing a supply voltage;

a plurality of constant current sources, each of which is configured to control a driving current flowing through a corresponding one of said plurality of LED columns of said plurality of LEDs in accordance with display data when a corresponding one of said plurality of LED rows of said plurality of LEDs is powered by said supply voltage, so that brightness is corresponding to said display data; and a plurality of voltage limiting modules, each of which is configured to be connected between a corresponding one of said plurality of constant current sources and a corresponding one of said plurality of LED columns of said plurality of LEDs, wherein current paths through a short-circuited one of said plurality of LEDs and an open-circuited one of said plurality of LEDs are disconnected by a corresponding one of said plurality of voltage limiting modules when there is a short-open failure occurring in said plurality of LEDs, preventing said plurality of LEDs from being turned on abnormally, wherein each one of said plurality of voltage limiting modules comprises:

a comparator having a positive input terminal configured to receive a voltage sampling signal representing a terminal voltage of a corresponding one of said plurality of constant current sources, a negative input terminal configured to receive a reference voltage, and an output voltage providing a switching control signal; and a switch having a control terminal coupled to said output terminal of said comparator for receiving said switching control signal, a first current terminal coupled to a cathode of each LED arranged in a corresponding one of said plurality of LED columns, and a second current terminal coupled to a high-voltage terminal of a corresponding one of said plurality of constant current sources.

2. The LED display device according to claim 1, wherein a plurality of output terminals of said row driving module are configured to be coupled to anodes of said plurality of LED rows of said plurality of LEDs, respectively, and each one of said plurality of constant current sources is configured to couple to a cathode of a corresponding one of said plurality of LED columns of said plurality of LEDs through a corresponding one of said plurality of voltage limiting modules.

3. The LED display device according to claim 1, wherein the terminal voltage of each one of said plurality of constant current sources is equal to a first voltage under a non-operating state, to a second voltage under a normal-operating state, and to a third voltage under an abnormal-operating state, wherein said reference voltage is less than said first voltage, less than said second voltage and higher than said third voltage.

4. The LED display device according to claim 3, wherein under said normal-operating state, each one of said plurality of constant current sources is configured to provide said driving current flowing through a first current path, wherein said first current path is configured to reach a corresponding one of said plurality of constant current sources through the LED which is arranged in a corresponding one of said plurality of LED rows, when the LEDs arranged in that corresponding one of said plurality of LED rows of said plurality of LEDs obtain said supply voltage.

5. The LED display device according to claim 3, wherein among the plurality of constant current sources, each constant current source operating under said abnormal-operating state is configured to provide said driving current flowing through a second current path, wherein said second current path is configured to reach a corresponding one of said plurality of constant current sources through at least one of the LEDs arranged in the LED row comprising a short-circuited LED and at least one of the LEDs arranged in the LED row comprising an open-circuited LED, when the LEDs arranged in a corresponding one of said plurality of LED rows obtain said supply voltage.

6. The LED display device according to claim 3, wherein said first voltage is roughly equal to said supply voltage, said second voltage is roughly equal to said supply voltage minus a first turn-on voltage drop across a single one of said plurality of LEDs, said third voltage is roughly equal to said supply voltage minus a second turn-on voltage drop across two series-connected LEDs of said plurality of LEDs.

7. The LED display device according to claim 1, wherein said positive input terminal of said comparator is configured to be connected to said first current terminal of said switch for obtaining said voltage sampling signal.

8. The LED display device according to claim 1, further comprising a plurality of capacitors, each one of said plurality of capacitors is connected between ground and said positive input terminal of said comparator in a corresponding one of said plurality of voltage limiting modules, in order to store said corresponding voltage sampling signal during a frame cycle.

9. The LED display device according to claim 8, wherein said plurality of capacitors are parasitic capacitors or additional capacitance elements.

10. A method for driving an LED display device, wherein said LED display device comprises an LED array comprising a plurality of LEDs arranged to form a plurality of LED rows and a plurality of LED columns, said method comprises:

scanning said plurality of LED rows in each frame cycle;

providing a supply voltage to a corresponding one of said plurality of LED rows of said plurality of LEDs in each row scanning phase of said frame cycle;

controlling a driving current flowing through a corresponding one of said plurality of LED columns of said plurality of LEDs according to display data, so that brightness is corresponding to said display data;

turning off current paths through a short-circuited one of said plurality of LEDs and an open-circuited one of said plurality of LEDs when there is a short-open failure occurring in said plurality of LEDs, for preventing said plurality of LEDs from being abnormally turned on;

controlling said driving currents each flowing through said plurality of LED columns of said plurality of LEDs by use of a plurality of constant current sources, respectively; and comparing a reference voltage with voltage sampling signals representing terminal voltages of said plurality of constant current sources to obtain comparison results, and determining whether a short-open failure occurs in said plurality of LEDs according to said comparison results, wherein for one of the plurality of LEDs, when a corresponding one of the voltage sampling signals is not greater than the reference voltage, a corresponding current path through said one of the plurality of LEDs is disconnected under control of a corresponding one of the comparison results.

11. The method according to claim 10, wherein for said one of the plurality of LEDs, when a corresponding one of the voltage sampling signals is not greater than the reference voltage, the corresponding current path through said one of the plurality of LEDs is disconnected by a switch having a control terminal controlled by the corresponding one of the comparison results, a first current terminal coupled to a cathode of each LED arranged in a corresponding one of said plurality of LED columns, and a second current terminal coupled to a high-voltage terminal of a corresponding one of said plurality of constant current sources.

12. The method according to claim 10, wherein said terminal voltage of each of said plurality of constant current sources is equal to a first voltage under a non-operating state, to a second voltage under a normal-operating state, and to a third voltage under an abnormal-operating state, wherein said reference voltage is less than said first voltage, less than said second voltage and higher than said third voltage.

13. The method according to claim 12, wherein, under said normal-operating state, each of said plurality of constant current sources is configured to provide said driving current flowing through a first current path, wherein said first current path is configured to reach a corresponding one of said plurality of constant current sources through the LED which is arranged in a corresponding one of said plurality of LED rows, when that corresponding one of said plurality of LED rows obtains said supply voltage.

14. The method according to claim 12, wherein among the plurality of constant current sources, each constant current source operating under said abnormal-operating state is configured to provide said driving current flowing through a second current path, wherein said second current path is configured to reach a corresponding one of said plurality of constant current sources through at least one of the LEDs arranged in the LED row comprising a short-circuited LED and at least one of the LEDs arranged in the LED row comprising an open-circuited LED, when a corresponding one of said plurality of LED rows obtains said supply voltage.

15. The method according to claim 12, wherein said first voltage is roughly equal to said supply voltage, said second voltage is roughly equal to said supply voltage minus a first turn-on voltage drop across a single one of said plurality of LEDs, said third voltage is roughly equal to said supply voltage minus a second turn-on voltage drop across two series-connected LEDs of said plurality of LEDs.

16. The method according to claim 12, wherein capacitors are introduced for storing said voltage sampling signals during said frame cycle.

17. The LED display device according to claim 1, wherein when there is a short-open failure occurring in said plurality of LEDs, said short-circuited one of said plurality of LEDs and said open-circuited one of said plurality of LEDs are arranged in different rows and different columns, and one of said current paths passes through more than one of said plurality of LEDs.

* * * * *